United States Patent [19]

Bell

[11] Patent Number: 4,548,528

[45] Date of Patent: Oct. 22, 1985

[54] TRENCH SHORING APPARATUS

[76] Inventor: Noel G. Bell, 52 W. Hudson Ave., Englewood, N.J. 07631

[21] Appl. No.: 459,395

[22] Filed: Apr. 18, 1983

[51] Int. Cl.[4] ..... E21D 5/12

[52] U.S. Cl. ..... 405/283; 405/272; 405/282

[58] Field of Search ..... 405/272, 282, 283, 258, 405/273

[56] References Cited

U.S. PATENT DOCUMENTS

| | | | |
|---|---|---|---|
| 1,267,058 | 5/1918 | Clarkson | 405/283 X |
| 3,309,799 | 3/1967 | Kinkade | 405/174 X |
| 3,541,799 | 11/1970 | Jost et al. | 405/283 |

FOREIGN PATENT DOCUMENTS

| | | | |
|---|---|---|---|
| 279732 | 5/1967 | Australia | 405/283 |
| 1152065 | 7/1963 | Fed. Rep. of Germany | 405/283 |

*Primary Examiner*—Dennis L. Taylor

[57] ABSTRACT

The invention refers to means of shoring trench excavation.

It provides a trench shoring apparatus which supports the walls of the trench and can travel by its own power or be pulled behind an excavator and consists of panels which line the walls of the trench and have braces across the trench between them, each panel comprising a frame that supports a vertical tread endless crawler track which travels longitudinally around the frame, the panel being enclosed to prevent the entry of earth, and of a construction and size suitable for being easily joined to others and cross braced to form an assembly for various depths of trenches.

The apparatus may be used for underwater pipelaying.

13 Claims, 27 Drawing Figures

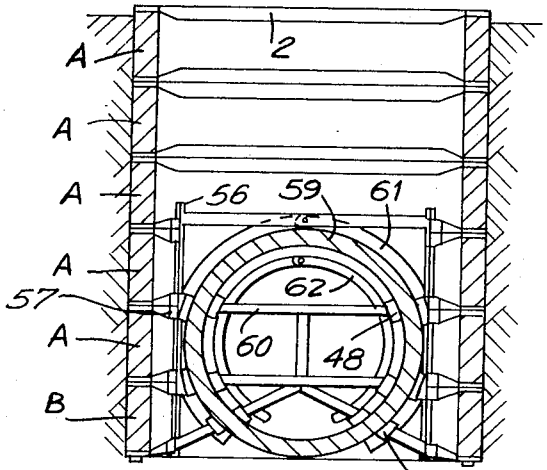
FIG. 21
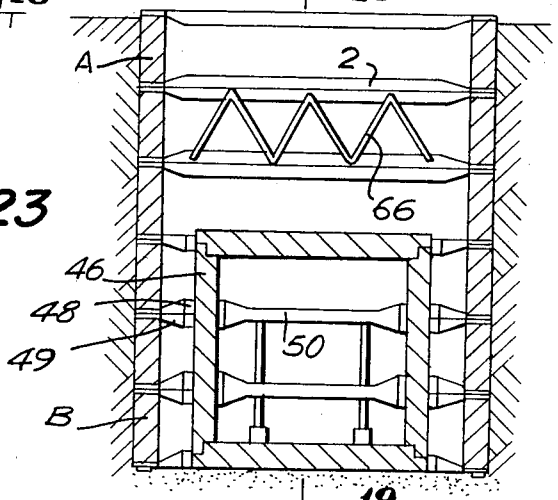
FIG. 20
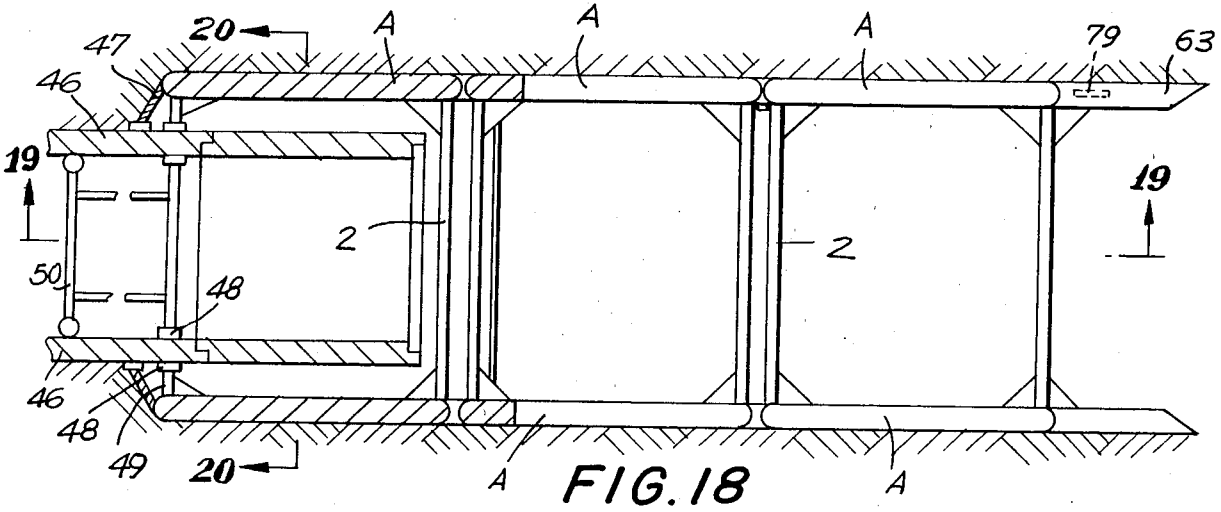
FIG. 18
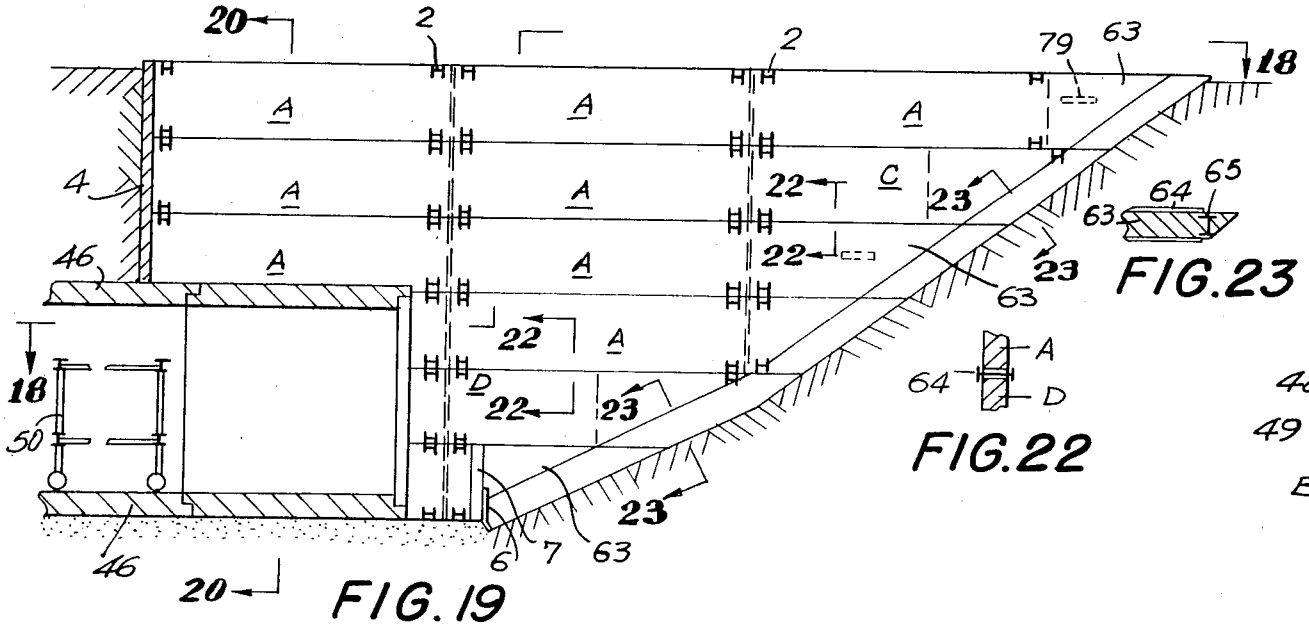
FIG. 23
FIG. 22
FIG. 19

TRENCH SHORING APPARATUS

This invention refers to means of shoring trench excavation.

It is an addition to my Patent Application of the same title of Jan. 20, 1983 for: "a trench shoring apparatus which supports the walls of the trench and can travel by its own power or be pulled behind an excavator and consists of panels which line the walls of the trench and have braces across the trench between them, each panel comprising a frame that supports a vertical tread endless crawler track which travels longitudinally around the frame, the panel being enclosed to prevent the entry of earth, and of a construction and size suitable for being easily joined to others and cross braced to form an assembly for various depths of trenches."

This invention provides a vibratory means attached to or incorporated in the stationary parts of the apparatus (that is stationary with respect to the apparatus) which are in contact with the earth, for example, the trapezoidal nose filler pieces, caps, sills and junction pieces. Further, in this case, if there is any danger of the apparatus tending to sink due to the vibration, the panel walls may be set on a slight batter as mentioned in the earlier application.

This invention refers to means of shoring trench excavation.

It provides a trench shoring apparatus which supports the walls of the trench and can travel by its own power or be pulled behind an excavator and consists of panels which line the walls of the trench and have braces across the trench between them, each panel comprising a frame that supports a vertical tread endless crawler track which travels longitudinally around the frame, the panel being enclosed to prevent the entry of earth, and of a construction and size suitable for being easily joined to others and cross braced to form an assembly for various depths of trenches.

It has the following additional features:

A pipe sprinkler system or provision for washing down and removing mud or silt from inside the panels.

A horizontal tread crawler track in the bottom panel.

Other features which will be described.

The invention futher provides an underwater automotive pipelaying apparatus.

The following drawings show some embodiments of the apparatus.

LIST OF DRAWINGS

Figure 1:
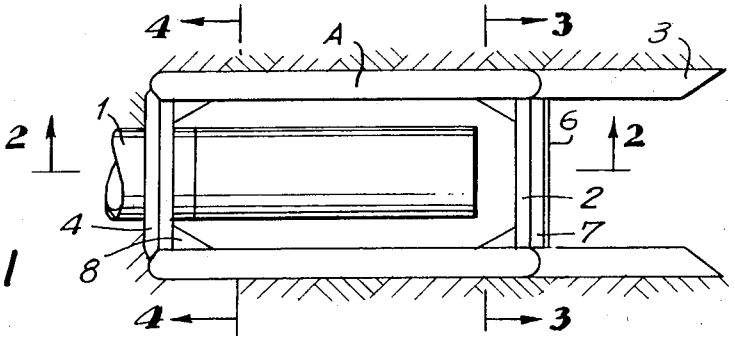
Figure 2:
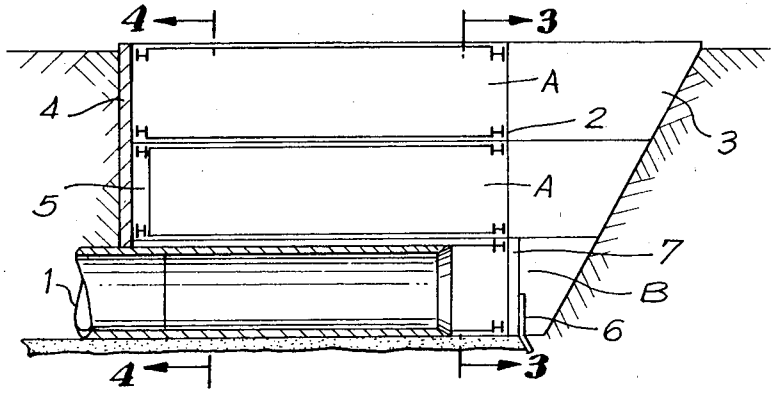
Figure 3:
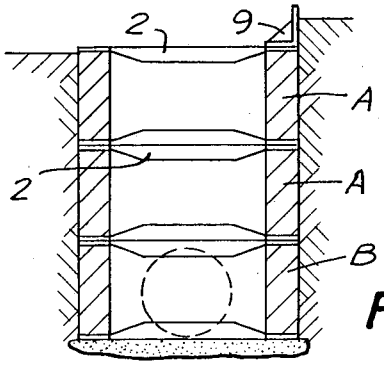
Figure 4:
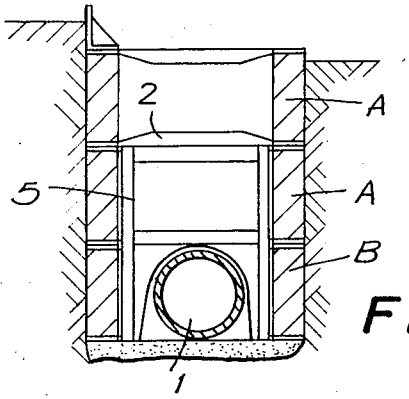
Figure 5:
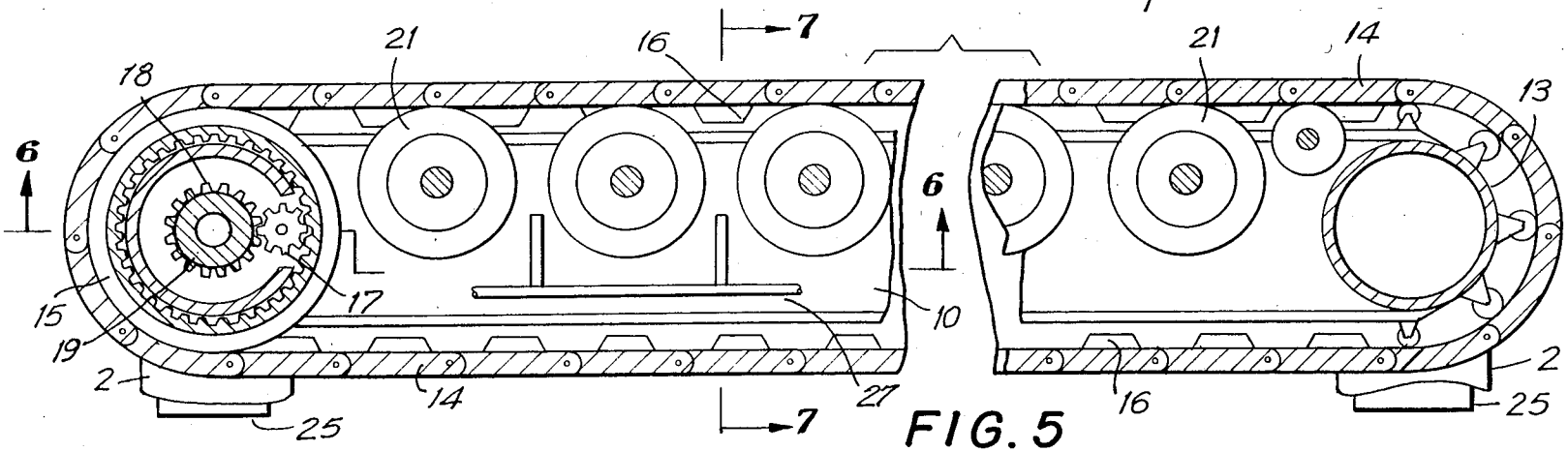
Figure 7:
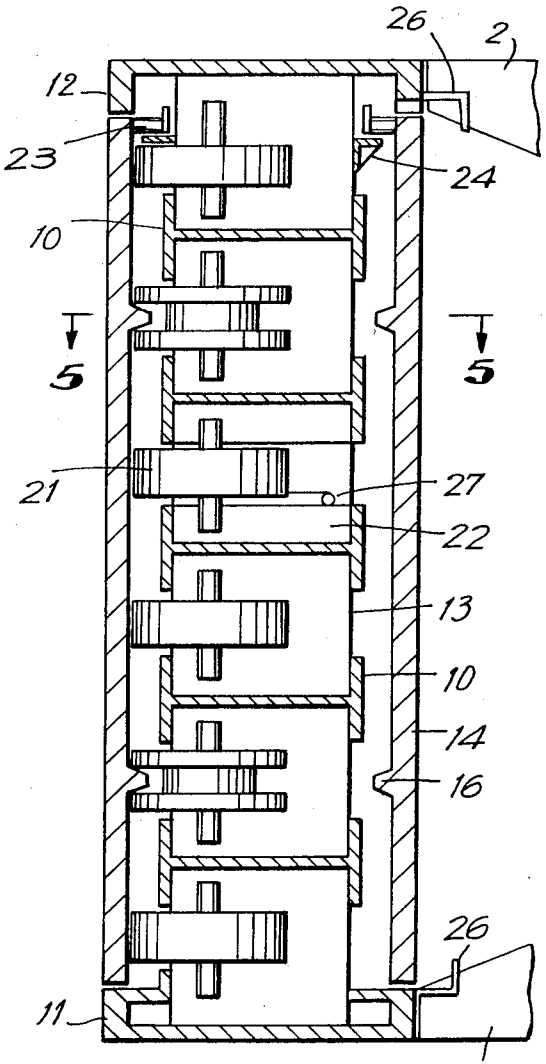
Figure 6:
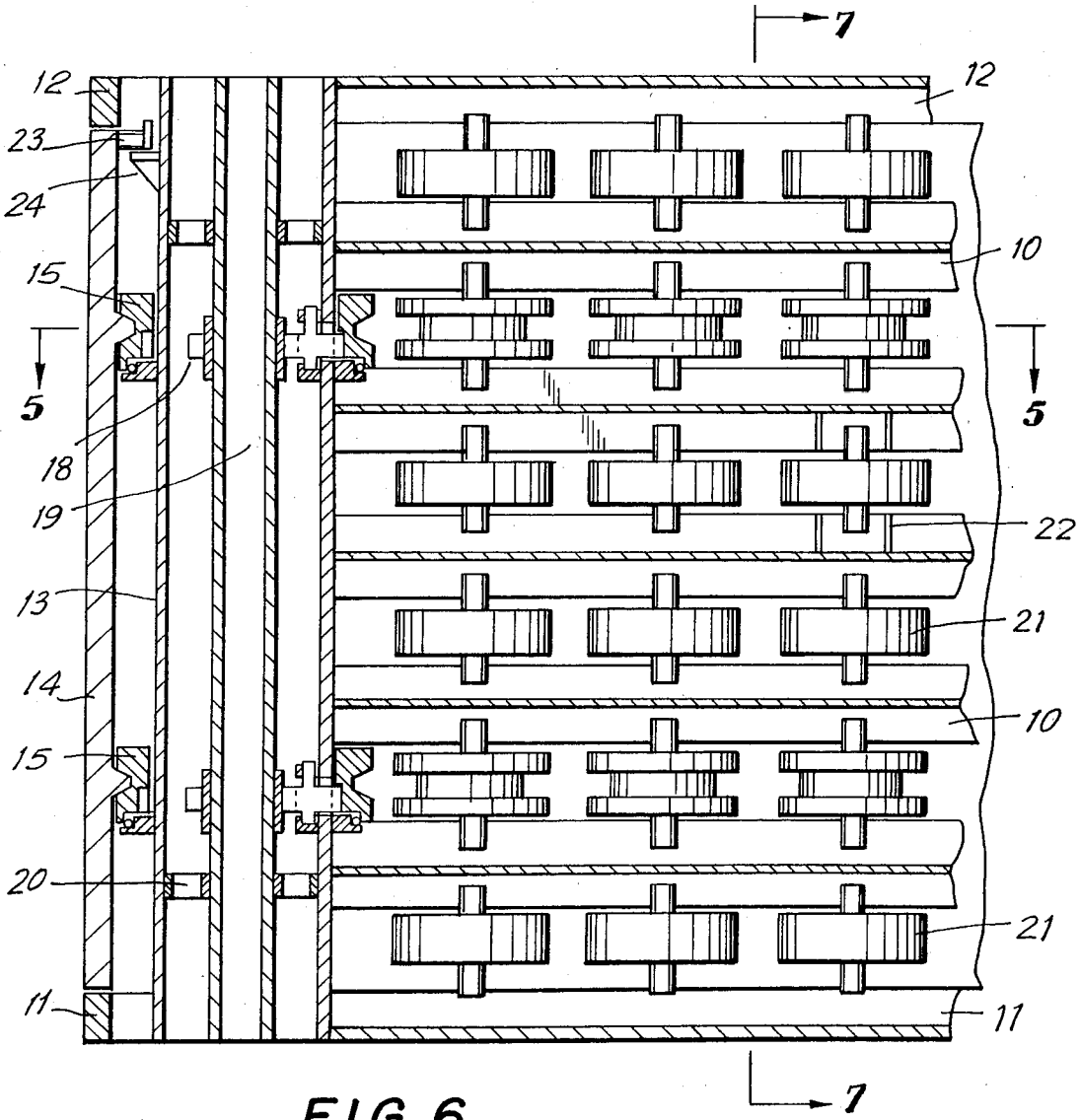
Figure 10:
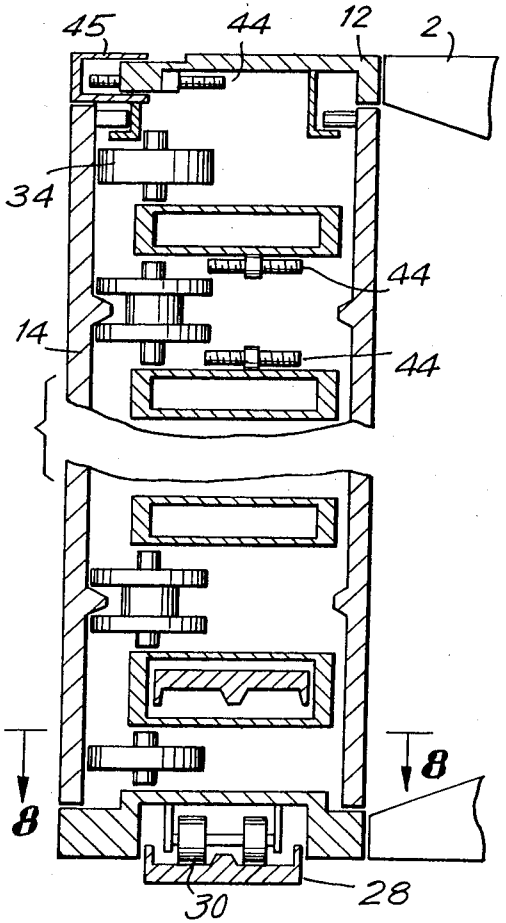
Figure 8:
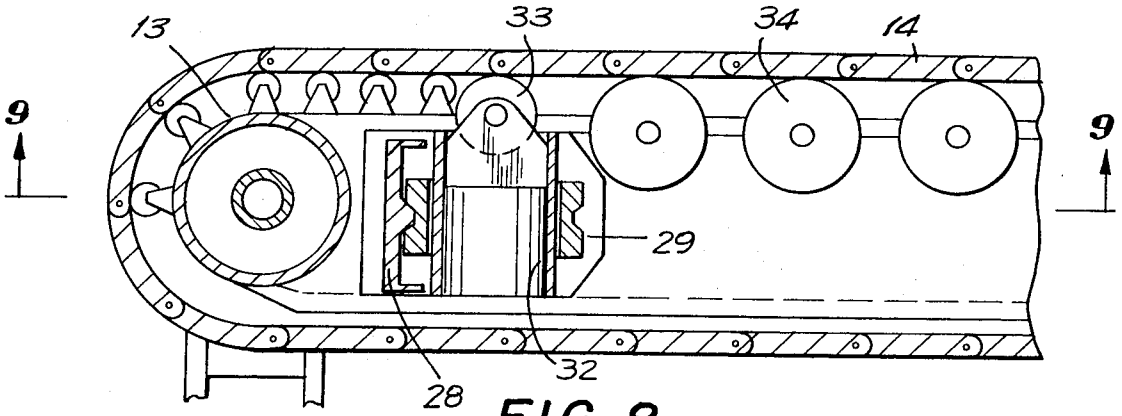
Figure 9:
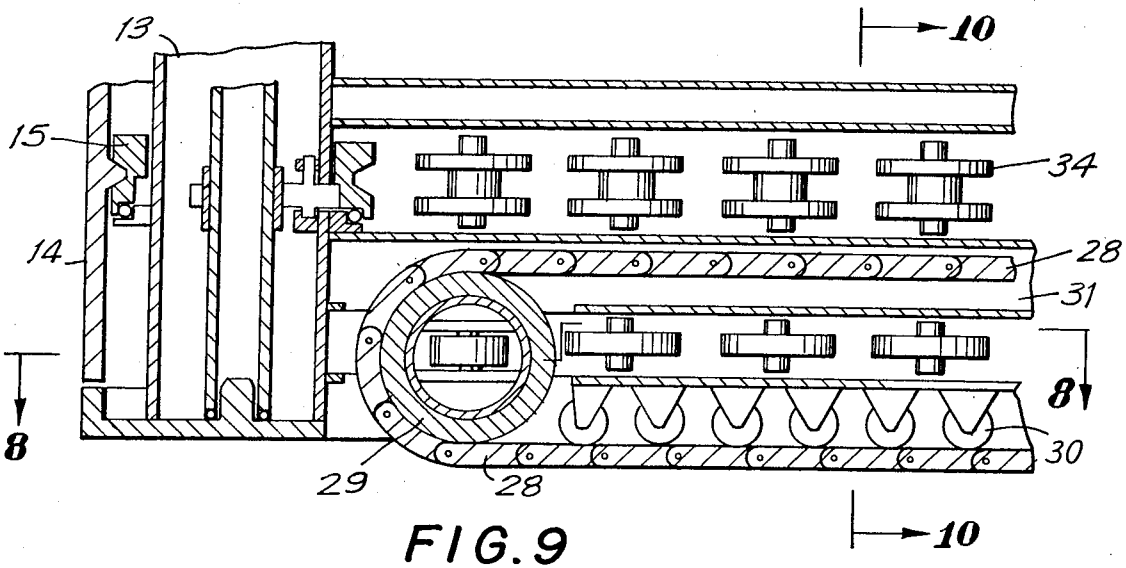
Figure 11:
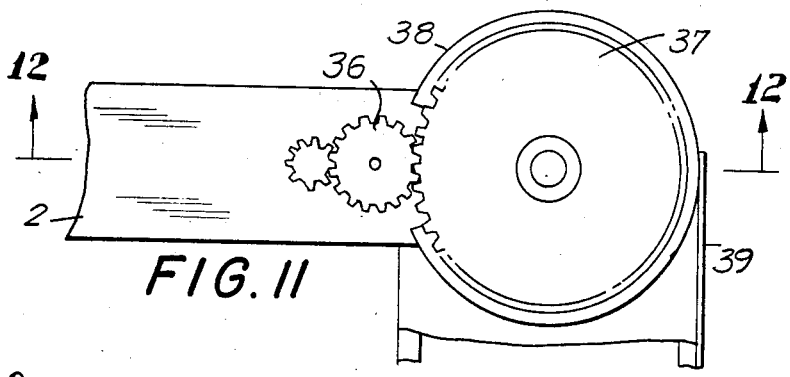
Figure 12:
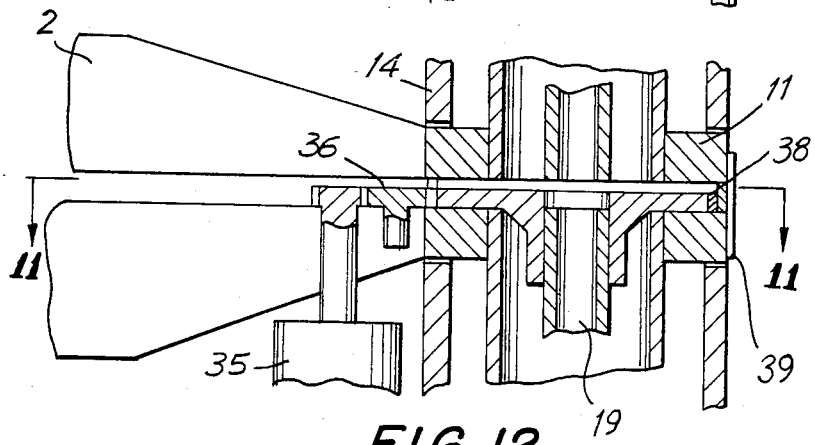
Figure 13:
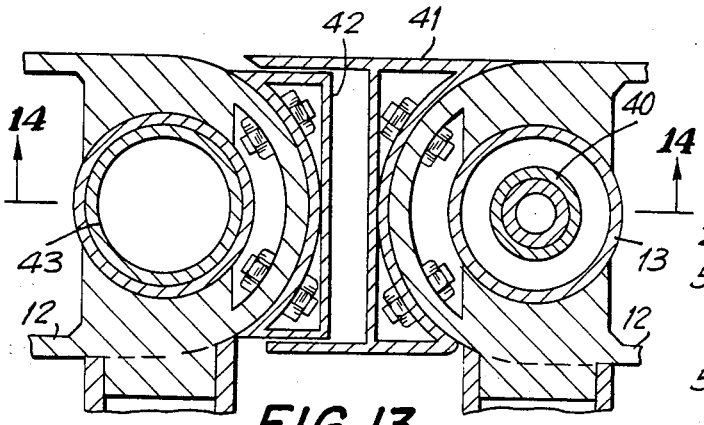
Figure 14:
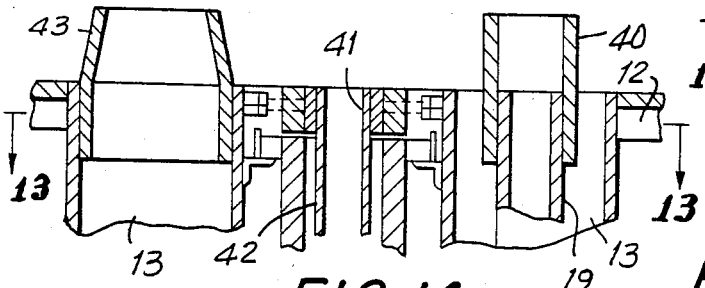

FIG. 1 is a plan of an apparatus.
FIG. 2 is a vertical long section of FIG. 1.
FIG. 3 is a cross section of FIG. 1.
FIG. 4 is another cross section of FIG. 1.
FIGS. 5 thru 17 are to an enlarged scale.
FIG. 5 is a part plan section of a standard panel (called A).
FIG. 6 is a part vertical long section of FIG. 5.
FIG. 7 is a cross section of FIG. 5.
FIG. 8 is a part plan section of a modified panel (called B).
FIG. 9 is a part vertical long section of FIG. 8.
FIG. 10 is a part cross section of FIG. 8.
FIG. 11 is a plan section of a power drive.
FIG. 12 is a vertical section of FIG. 11.
FIG. 13 is a plan section of junction pieces.
FIG. 14 is a part vertical section of FIG. 13.

Figure 15:
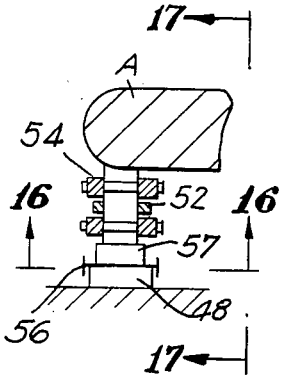
Figure 16:
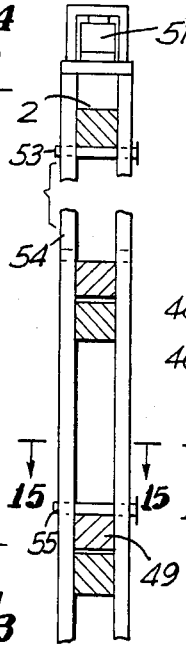
Figure 17:
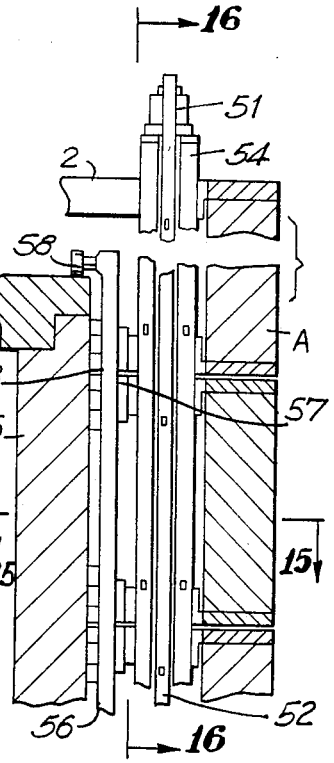
Figure 24:
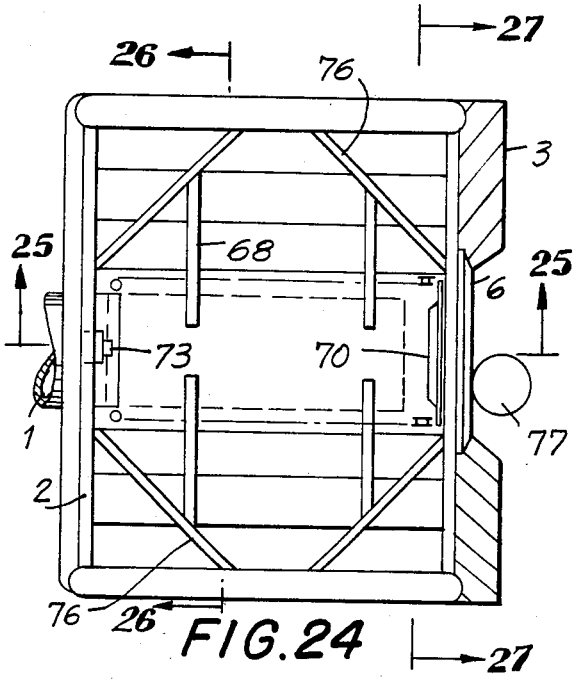
Figure 27:
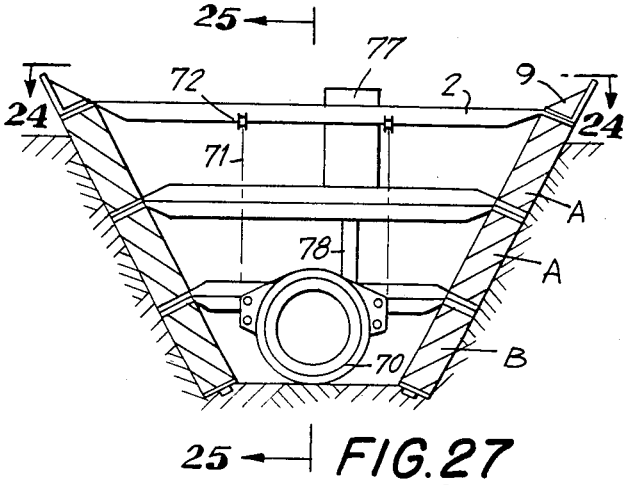
Figure 25:
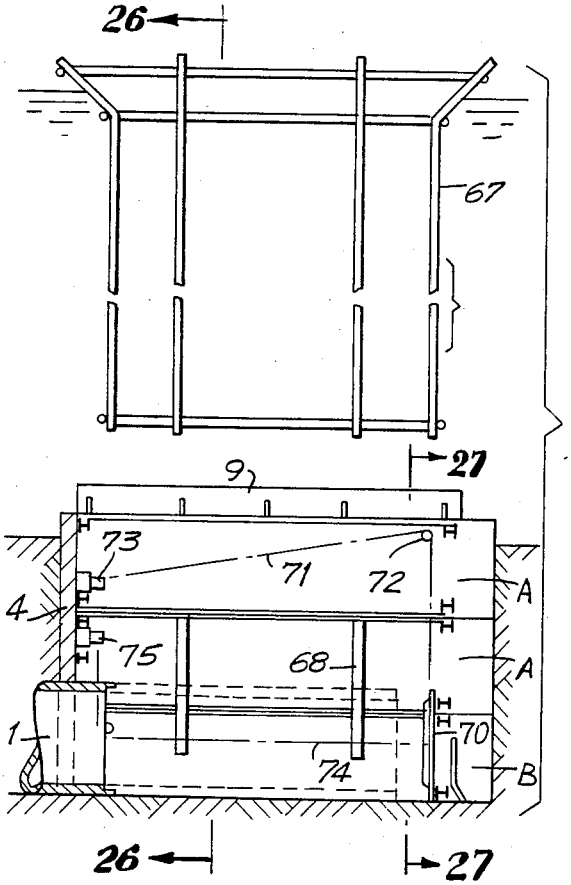
Figure 26:
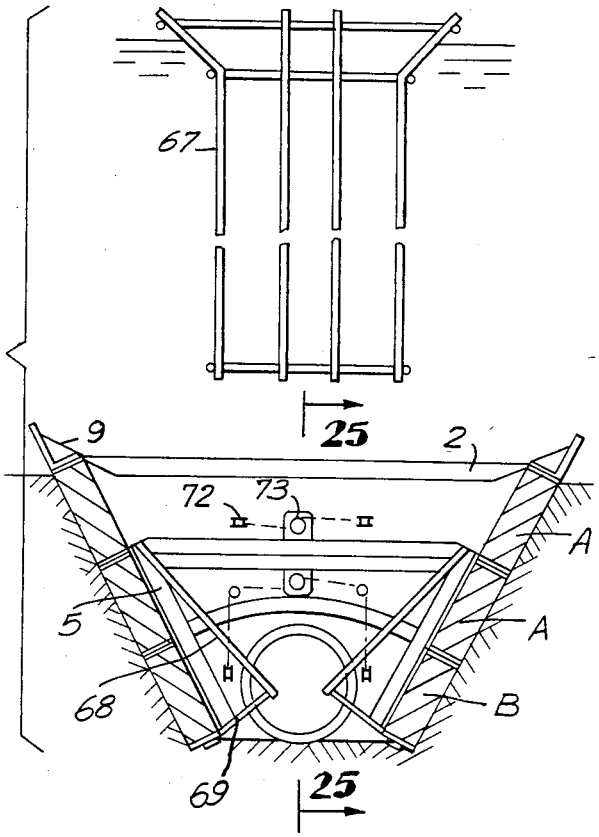

FIG. 15 is a plan section of means of raising panels.
FIG. 16 is a part vertical section of FIG. 15.
FIG. 17 is another part vertical section of FIG. 15.
FIG. 18 is a plan, partly in section, of a deeper trench.
FIG. 19 is a vertical long section of FIG. 18.
FIG. 20 is a cross section of FIG. 18.
FIG. 21 is another cross section of FIG. 18.
FIG. 22 is a cross section of a detail of FIG. 19.
FIG. 23 is another cross section of a detail of FIG. 19.
FIG. 24 is a plan of an underwater pipelayer.
FIG. 25 is a vertical long section of FIG. 24.
FIG. 26 is a cross section of FIG. 24.
FIG. 27 is another cross section of FIG. 24.

FIGS. 1, 2, 3 and 4 show an apparatus for laying a pipeline 1. The apparatus is three panels deep, consisting of two standard panels A and a bottom panel B on each side of the trench with cross braces 2 between them. There are cutting edge noses 3 on the front of the panels and a bulkhead 4 at the rear, and cantilever beams 5 to brace the sills of the bottom panels B. An adjustable dozer blade 6 and a container 7 for bedding material are mounted in the front. Knee braces 8 are placed at the ends of the cross braces 2. A small guard plate 9 may be fitted on top of the top panel.

FIGS. 5, 6 and 7 show a standard panel A comprising a frame consisting of longitudinal beams 10 and a sill 11 and cap 12 which are all welded at their ends to vertical cylinder beams 13, the frame being surrounded by a vertical tread endless crawler track 14 which travels longitudinally around the frame and is driven by sprocket wheels 15 which engage sprockets 16 on the treads of the track. The sprocket wheels are mounted on the cylinder 13 and have an internal gear which is driven by a spur gear 17 on a drive gear 18 on a drive shaft 19 which is centered by rings 20. Rollers 21 mounted on the beams 10 support the crawler track 14 against the pressure of the earth. The axle bearings of the rollers are housed in pairs of web stiffners 22 at each roller. The crawler track treads are carried by rollers 23 on brackets 24. Bosses 25 engage the ends of the cross braces 2. A second spur gear 17 may be mounted opposite that shown, if needed. On the inside face of the panel the slack in the crawler track is restrained by removable brackets 26. The beams and cap and sill are braced together vertically at intervals.

To allow access to the inside of the panel, special easily removable pins connecting the crawler track treads are provided at intervals in the tracks, so that a section of track on the inside face of the panel may be removed or peeled back. To facilitate this, a recess is provided in the lower part of the cap 12 as shown in FIG. 7, but some distance away from the cross brace 2.

A sprinkler system of piping 27 with necessary orifices is provided inside the panel to allow for jets of water or air or other fluids or mixtures under pressure to remove mud or silt which may leak into the panel through the joints in the crawler tracks. Weep holes are formed in the inside face of the sill for drainage. Alternatively holes may be provided in the inside face of the cap for insertion of curved nozzles with jets of pressure fluid. If necessary suction units may be inserted at the holes in the sills.

FIGS. 8, 9 and 10 show a panel B of the same size as A modified to incorporate a horizontal tread crawler track unit consisting of crawler track 28, sprocket wheel 29 and rollers 30. The upper part of the track travels through a longitudinal beam 31, the beams in this panel being box beams. Where the web of the box beam and part of the sill are cut away to allow room for the sprocket wheel 29, a pipe 32 is inserted to strengthen the beam and sill and form a seating for the sprocket wheel. A roller 33 is housed in this pipe. Smaller track rollers 34 are shown in this panel.

As shown in FIGS. 11 plan and 12 vertical section, a drive may be provided for each panel by, for example, a motor 35, preferably hydraulic, mounted under the cross brace 2, which drives a spur gear 36 which engages a gear 37 attached to the drive shaft 19. A spacer ring 38 separates the panels and a removable cover plate 39 is bolted to the sill 11. Alternatively the motor may be mounted on top of the top panel and the drive transmitted by clutches 40 shown in FIGS. 13 and 14, the clutches having a certain amount of play.

When the path of the trench is curved and panels are in longitudinal alinement as in FIG. 18 it is necessary to increase the space between the ends of the panels on the outside of the curve and decrease the space on the inside. Telescopic junction pieces 41 and 42 for this purpose, shown in FIG. 13 plan section and 14 vertical section, are bolted to the ends of the caps and sills, the bolt holes being slotted slightly horizontally. On the curve the outside panels are driven slightly faster than those on the inside. Ties are provided on the ends of the adjacent cross braces 2 to prevent the panels moving too far apart. A tapered internal sleeve 43 for centering the panels on top of each other is shown in these Figs.

If necessary, the sides of the panels can be made concave or convex as required, as shown in the upper part of FIG. 10, by means of jacks, for example screw jacks 44, which engage the housings of the axles of the track rollers 34 and move them in or out, and thus the track 14. The outside edges of the cap and sill are waisted between their ends and a movable edge 45 is provided which can be moved by the jacks 44, the movable edge being in short lengths whose ends overlap.

FIGS. 18, 19 and 20 show a deeper trench for a subway made of precast box units 46. Where it is important to avoid losing ground bulkheads 4 and 47 are formed at the rear of the apparatus, and the sides of the slope in the front of the trench are lined as shown.

At the rear of the working chamber the ends of the lower panels have to be strutted against the sides of the precast units. Dollies 48 consisting of a frame with an endless chain of rollers, of the type used for moving heavy loads on factory floors, are mounted on the ends of the struts 49 to allow the struts to roll forward on the units. Where the sides of the precast units are not strong enough to take the concentrated loads of the dollies corresponding opposing dollies 48 are mounted on a travelling frame 50 inside the precast units. The frame has lines tied to the cross braces 2 so that it travels at the same rate as the shoring apparatus, or it may have its own power unit. The frames may also have jacks at the dollies on one side to control the pressure.

On vertical curves it is necessary to raise one end of the panels—the front end on an upward curve and the rear end on a downward curve. A cover plate 39, FIGS. 11 and 12, is therefore bolted to the outside face of the sill and extends downward equal to the depth of the cap of the panel below. Cable ties around the ends of the cross braces at adjacent caps and sills limit the rise of the latter. In the case of shallow trenches only one or two panels deep, the ends of the panels may be lifted by a crane.

In deeper trenches individual panels may be raised by utilising the friction on some of the others as a reaction. As shown in FIGS. 15 plan and 16 and 17 vertical sections (FIG. 17 being an enlarged view of part of FIG. 20), the ends of the panels may be raised successively, starting at the top, by means of a jack 51, preferably hydraulic, connected to a pair of straps 52 with a pin 53 through the straps under the cross brace 2 of the cap of the panel. The jack is mounted on two pairs of columns 54 supported by pins 55 resting on the strut 49 of the sill of, say, the second lowest panel. When the upper panels are raised the pins in the columns are transferred to the cross brace of the top panel and the lower panels are raised. In the Figs. shown the struts 49 have to move in two directions, vertically for the vertical curve and horizontally to travel, therefore an I beam 56 is provided and a dolly 57 on the end of the strut rolls vertically on the web, and the beam carries a dolly 48 which travels horizontally on the precast box 46. The beam is carried by a roller 58 which travels on top of the precast box. This beam and dolly are omitted for clarity from FIG. 20.

On vertical curves when panels are in longitudinal alinement as in FIG. 18, it is necessary to increase the space between the ends of the panels at the top when the curve is downward and at the bottom when the curve is upward. Therefore on the downward curve, as the rear ends of the panels are raised successively the upper panels have to move forward proportionately. On the upward curve the lower panels have to move forward correspondingly. It is to facilitate this movement that the internal sleeve 43 in FIG. 14 is tapered.

FIG. 21 shows a precast tunnel segment 59 with an internal travelling frame 60 similar to frame 50. In this instance the rollers of the horizontal dollies 48 on the external and internal struts 49 must be made slightly concave and convex respectively to conform to the curvature of the segment. The vertical I beams 56 are shown in this view and are supported by a vertical ring 61 which is carried by the dollies 48. Similarly the internal frame 60 is supported by a ring 62 which is carried by the internal dollies 48.

In the case of the precast box units, FIG. 20, the units may be bolted together and dowel hairpins may be provided and concrete fillets poured at the corners after the shoring apparatus has passed. Where circular concrete tunnel segments are used, as FIG. 21, they may have precast floors and ceilings, and provision can be made in these for post tensioning the segments together to make a continuous structure.

As shown in FIG. 19 the walls of the slope are lined with standard panels A and similar but shorter panels C and D and filler pieces 63 of various length. To leave the space for excavation as open as possible, the intermediate cross braces for the short panels and filler pieces are omitted and beams 64 and 65 as shown in FIGS. 22 and 23 are provided. If the excavation is done by a trenching machine with a ladder and endless chain of buckets, the bottom of the slope would have to be straight without the bend as shown.

A bridle may be mounted on an excavator ahead and connected to the apparatus to help moving it. The crawler track treads may have cleats to give better traction if necessary, but extra clearance would be needed at the noses 3 and the telescopic junction pieces 41 and 42, FIGS. 13 and 14.

The faces of the caps and sills and filler pieces 63 in contact with earth may have a coating of friction reducing material, and may have small holes for lubricating fluids.

The cross braces 2 may have vertical bracing 66 as shown in FIG. 20 and temporary horizontal connectors at adjacent braces while moving. In addition, in very wide trenches, a temporary bracing frame spanning across the trench and with hydraulic jacks at one end may be used while moving.

Where ground is poor and water laden, the water may be left in and the units or segments placed by divers. Where the ground is very bad a slurry, say bentonite, may be used. Also in these conditions the panel walls may be set on a slight batter, as shown but less than in FIGS. 26 and 27. In the case of a batter where there are vertical curves, jacks, preferably screw jacks, may be fixed at the ends of the cross braces to increase their length as the panels are raised.

A continuous flexible rubber or plastic belt could be placed over the crawler track 14 or substituted for it, to keep out silt or mud.

An additional working chamber may be provided behind the one shown in FIGS. 19 and 18 so that more than one operation may be performed at the same time, for example, piledriving in one and laying floor in the next.

The strength of the panels may be varied by having light beams for the tops of trenches and heavier beams for the bottoms of deep trenches. Also the bottom panels may be wider. Upper panels may be removed to pass under obstructions.

The prime power units may travel alongside the trenches or on top of the panels.

The excavation can be continuous if the work chamber is longer than the pipe by an amount equal to the ratio of the time to lay the pipe to the time for excavating the length of the pipe.

In a special case, if it were desired to have the length of the treads of the crawler track extend the full depth of a deep trench, the intermediate caps and sills could be removed and replaced with dollies 48 at the tops and bottoms of the cylinder beams 13 opposite the cross braces, and corresponding dollies could be placed on the ends of the cross braces. In this case the cross braces would have to be framed together as a unit and connected to the top cap and bottom sill.

FIGS. 24 to 27 show an apparatus for laying pipes or tunnel segments under water. The sides of trenches under water stand at a fairly steep slope, even in sand if not subject to wash of waves and not left open. Therefore with panels on a batter as shown there would not be heavy pressure on the walls, and cantilever beams 5 as previously shown in FIGS. 2 and 4 would probably be sufficient to take the loads even in deeper structures, without the complications of transferring the loads to the permanent structure.

Floatation pontoons may be attached at the top of the apparatus and the cross braces 2 made tubular to lighten it. Thus a lift on either end from a crane on a barge should be sufficient for negotiating vertical curves.

A telescopic fairlead cage 67 guides the pipe into place. It is shown clear of the apparatus for clarity. The upper portion which has the outside tubes floats on the surface. The lower internal tubes are closed at their ends to make them buoyant and are lashed non-rigidly to the bottom cross tube frame which is tied to the bracing of the apparatus. An adjustable cable on each side connects the top to the bottom to prevent it moving too far.

Pairs of beams 68 hinged at the top and with springs 69 at the bottom cushion the landing of the pipe when it is lowered from a crane on a barge which moves with the waves. When the pipe 1 (shown dotted) lands, a circular open frame 70 is lowered by cables 71 (shown chain dotted) through sheaves 72 from a winch 73 and pulled onto the end of the pipe by cables 74 from a winch 75. The winch 75 keeps a strain on the frame to prevent any tendency of the pipe to move as the apparatus advances. The cross braces 2 have auxiliary braces 76 as shown and vertical bracing 66 as in FIG. 20.

Excavation may be by a dredge suction pump 77 and suction 78 mounted in front of the apparatus with its discharge pipe leading to the rear to backfill, or by other type of dredge or by a floating dredge on the surface. A small pipe with orifices may be fitted along the nose 3 to either suck or jet material at the leading edge. A cap may be fitted under the frame 70 to keep out dirt. A shallow hole may be excavated at the end of the pipe after laying, by a suction or airlift, to prevent any earth being dragged into the joint when the next pipe is laid.

When there is not much pressure at the top of the trench, the upper panels may be replaced by plain box panels of the same size but without crawler tracks.

Motors for moving the apparatus may be mounted as previously described and power for the motors, dredge pump and winches can be supplied from the crane barge on the surface.

Television cameras with lights may be used to reduce the use of divers.

Of course any means described for one assembly may be used where applicable on any other assembly. For example, the I beam 65 shown in FIG. 23 may be used in the nose 3 of FIGS. 1 and 2; and the I beam 64 may be used as a cantilever beam on top of the top panel, although in the latter case a heavy channel beam would be better to allow for bending the nose on a curve.

I claim:

1. An apparatus which shores the walls of a trench including those of the sloping part and can travel along the trench by its own power and support its weight by the friction of the earth on its sides, the apparatus comprising longitudinal panels which line the walls of the trench, each panel consisting of a frame which supports an endless crawler track, with vertical treads, that travels longitudinally around the frame, the frame having a cap and a still that together with the crawler track treads totally enclose the panel and prevent earth entering it, the sill of each panel being adapted to fit the cap of the panel below it and prevent entry of earth between them, and the panels being supported by braces across the trench between the caps, and between the sills, of opposite panels.

2. An apparatus as claim 1, with sprinkler systems on the frames inside the panels for washing down and removing mud or silt from inside the panels.

3. An apparatus as claim 1, incorporating an endless crawler track, with horizontal treads, in the bottom of the bottom panel.

4. An apparatus as claim 1, having individual power drives to each panel.

5. An apparatus as claim 1, with means to enable it to travel on horizontal curves, by having curved face telescopic junction pieces between the ends of the panels, and by driving the panels on the outside of a curve faster than those on the inside.

6. An apparatus as claim 1, having means to enable it to travel on vertical curves, by raising the front end of each panel successively for upward curves and the rear end for downward curves.

7. An apparatus as claim 6, having means utilizing the friction of the earth on some panels as a reaction for raising the ends of others.

8. An apparatus as claim 1, having means for transferring the earth loads of the panels to the permanent structures where the structures interfere with the line of the cross braces, said means comprising struts with dollies, consisting of a frame with an endless chain of rollers, which roll on the structure.

9. An apparatus as claim 8, having similar means for relieving the stress in the structures due to the concentrated loads from the panels, said means being located inside the structures.

10. An apparatus as claim 1, the panels being set on a batter to reduce the pressure on the cross braces and on the bottom of the trench.

11. An apparatus as claim 1, having vibratory means attached to its stationary parts which are in contact with the earth, for example, the nose filler pieces, caps, sills and junction pieces.

12. An apparatus as claim 1, having a plurality of working chambers.

13. An apparatus as claim 1, the means of traveling by its own power consisting of each panel having a drive shaft enclosed inside it which drives its crawler track and is driven by gears which are driven by a motor mounted on a cross brace.

* * * * *